US008834101B2

(12) United States Patent
Monnot

(10) Patent No.: US 8,834,101 B2
(45) Date of Patent: Sep. 16, 2014

(54) MECHANICAL SEAL FOR LARGE PUMPS

(71) Applicant: Flowserve Management Company, Irving, TX (US)

(72) Inventor: James A Monnot, Baton Rouge, LA (US)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 13/630,376

(22) Filed: Sep. 28, 2012

(65) Prior Publication Data

US 2013/0022460 A1 Jan. 24, 2013

Related U.S. Application Data

(63) Continuation of application No. PCT/US2011/003326, filed on Apr. 20, 2011.

(60) Provisional application No. 61/342,846, filed on Apr. 20, 2010.

(51) Int. Cl.
*F01D 5/14* (2006.01)
*F04D 29/12* (2006.01)

(52) U.S. Cl.
CPC ..... *F04D 29/126* (2013.01)
USPC ..... 415/126; 415/174.2; 415/214.1; 415/231

(58) Field of Classification Search
USPC ..... 415/126, 174.2, 214.1, 231
See application file for complete search history.

(56) References Cited

U.S. PATENT DOCUMENTS

| | | | |
|---|---|---|---|
| 3,743,302 | A | 7/1973 | Bach et al. |
| 3,977,737 | A | 8/1976 | Grzina |
| 4,439,096 | A | 3/1984 | Rockwood |

(Continued)

FOREIGN PATENT DOCUMENTS

| | | |
|---|---|---|
| EP | 0365303 | 4/1990 |
| WO | WO 86/04655 | 8/1986 |
| WO | WO 2008/141377 | 11/2008 |

OTHER PUBLICATIONS

International Search Report and Written Opinion of the International Searching Authority for PCT/US2011/033226, date completed Aug. 1, 2011, date mailed Aug. 8, 2011.

(Continued)

*Primary Examiner* — Edward Look
*Assistant Examiner* — Jason Davis
(74) *Attorney, Agent, or Firm* — Miller, Canfield, Paddock, and Stone; Mark L Maki

(57) ABSTRACT

An improved mechanical seal assembly is provided for hydro transport applications and other similar applications, such as large high pressure slurry pumps. This mechanical seal is used in large scale pumps having an axially adjustable shaft to accommodate high wear applications by maintaining suitable pump performance. The improved seal is a cartridge seal that includes a stationary seal adapter which is mounted to a pump casing and has a static gasket sealingly contacting a movable gland which non-rotatably supports the stationary seal rings of a mechanical seal. Additional seal rings are rotatably supported on the shaft wherein these rotatable and non-rotatable seal components are movable axially with the shaft to improve pump performance in high-wear conditions. The gland and non-rotatable seal rings are supported on and move with a bearing housing, along with the shaft and its seal rings.

20 Claims, 7 Drawing Sheets

(56) References Cited

U.S. PATENT DOCUMENTS

| | | | | |
|---|---|---|---|---|
| 4,509,773 | A | 4/1985 | Wentworth | |
| 4,575,306 | A | 3/1986 | Monnot | |
| 4,973,065 | A * | 11/1990 | Habich | 277/399 |
| 5,630,699 | A | 5/1997 | Kirby et al. | |
| 6,375,414 | B1 | 4/2002 | Delaney | |
| 7,168,915 | B2 | 1/2007 | Doering et al. | |
| 7,438,519 | B2 | 10/2008 | Torres-Reyes | |

OTHER PUBLICATIONS

The International Preliminary Report on Patentability and Written Opinion of the International Search Authority for PCT/US2011/033226, issued Oct. 23, 2012.

* cited by examiner

MECHANICAL SEAL FOR LARGE PUMPS

CROSS REFERENCE TO RELATED APPLICATIONS

This application is a continuation of PCT Patent Application No. PCT/US2011/033226, which claims priority to U.S. Patent Provisional Application No. 61/342,846, the disclosures of which are incorporated herein by reference in their entirety.

FIELD OF THE INVENTION

The invention relates to an improved mechanical seal assembly for hydro transport applications and other similar applications, such as large high pressure slurry pumps, and more particularly, to a mechanical seal used in large scale pumps having an axially adjustable shaft for use in high wear applications to maintain suitable pump performance.

BACKGROUND OF THE INVENTION

Mechanical seals are used on the rotatable shafts of rotating equipment to prevent or minimize leakage of a process fluid being handled by the rotating equipment. For example, pumps are used to pump process fluids through a pump casing by impellers. The rotatable shaft is typically supported by bearing assemblies and projects into the pump casing to drive the impeller. The mechanical seal is provided on the shaft to seal the process fluid chamber from the pump exterior, and in particular, prevent or minimize leakage of the process fluid along the shaft to the pump exterior. For many small scale applications, or applications where the impeller does not encounter excessive wear, the mechanical seal and shaft may be located in fixed locations. Should the impeller wear after a significant life cycle, the impeller may simply be replaced.

In some applications, the process fluid may generate substantial wear on the impeller, for example, if the process fluid includes a high volume or high concentration of abrasive solids that are combined with a liquid to form a slurry. These slurries pass through the impeller and can lead to significant wear of the impeller surfaces. When encountering a high wear rate of the impeller, it is undesirable to frequently replace an impeller since frequent replacement increases the operational costs of the pump and associated seal. In these circumstances, it is known in smaller scale applications to permit adjustment of the axial position of the shaft to shift the impeller axially within the pump chamber to increase the performance of the impeller as it wears and thereby extend the life cycle of such impeller. For these circumstances, mechanical seals have been designed which have a stationary housing and a gland that supports the seal rings wherein the gland is movable axially within the stationary housing so that the seal rings can move together with the shaft while still performing the sealing function. An example of one such seal is disclosed in U.S. Pat. No. 4,575,306 (Monnot) which is a component seal requiring assembly of the individual components during installation. Other examples include U.S. Pat. No. 3,977,737 (Grzina) and U.S. Pat. No. 4,509,773 (Wentworth).

While slurries have been handled in small scale applications, significant challenges are created in large scale hydro transport applications which require large high-pressure slurry pumps to pump slurries substantial distances. In particular, large high pressure slurry pumps used in applications such as hydro transport applications including tailings applications in the Mineral and Ore Processing (M&OP) industry wherein these pumps require either single or double pressurized slurry seals. These applications also include large moderately abrasive low pressure pumps found in Flue Gas Desulfurization (FGD) pumps.

These applications can be extremely abrasive requiring frequent impeller adjustment and replacement of high-wear, wet-end pump parts and mechanical seal components. These types of pumps exhibit ample register fits of cast components as well as internal clearances of bearings, and significant pump casing deflections from the high pressure and pipe strain encountered in use, which typically results in large shaft movement and seal face flange alignments.

Examples of such high pressure slurry pumps include Model HTP 500 and 600 pumps commercially sold by Weir which are used in oil sands hydro transport and tailings applications. These pumps include a shaft sleeve on the rotatable shaft, and a stuffing box disposed in surrounding relation to the shaft whereby a stuffing box chamber is formed that is filled with a plurality of axially adjacent packing rings. However, these packing rings typically permit leakage along the shaft and therefore, can incur significant water leakage costs and pump maintenance costs. This is particularly undesirable in remote facilities where a ready supply of water is not available or is not cost effective.

It therefore is an object of the invention to provide a mechanical seal that is suitable for installation in large slurry pumps which are being used in applications such as tailings transfer and tar sands ore transport.

The pumps for these large scale applications, such as the Weir HTP 500 and 600 pumps, are developed for pump speeds up to 500 RPM, and high pressure conditions which may reach 4000 kPa (580 psi) which can be the maximum allowable working pressure of the pump during operation, and reach 6000 kPa (870 psi) pressure which may occur during static hydro testing of the pump. Hydro transport and tailings slurries can be expected to have over 50 percent solids by weight. In some applications, maximum particle size can be 5"×5"×12" coming through worn 5"×5" screens, which may therefore require a full coverage back liner to protect the seal when mounted to the shaft. The seal in the inventive design preferably will accommodate 62 mm (2.5 inch) axial adjustment to allow for impeller adjustment which is needed in such applications due to the aggressive wear expected on the suction side liner, wherein the worst case for shaft run out may be over 0.030 in. radial, and over 0.076 in. TIR (total indicated reading) due to bearing clearances, shaft run out, and sleeve to shaft clearance and concentricity. Radial deflection typically will be at the bottom with a new impeller, and impeller wear will cause imbalance creating an orbit about the radial clearances. Further, the seal will need to accommodate a fraction of an inch TIR measured out of perpendicularity of the seal mounting surface and a quarter inch TIR concentricity with respect to the shaft due to standard slurry pump manufacturing tolerances and expected wear to the interface between a bearing assembly and bearing assembly mounting surface on a pump bearing assembly base which mounts next to the pump casing and rotatably supports the shaft. The improved seal preferably will need to accommodate impeller replacement every 2000 to 3000 hours and impeller adjustments by axial adjustment of the shaft approximately every 1000 hours or even less. Further, the mechanical seal preferably includes a barrier fluid at a desired pressure, wherein the seal is designed to handle a full process pressure of 580 psi in the event of a loss of barrier pressure.

The mechanical seal of the invention relates to a cartridge seal developed for such pumps which eliminates problems with the fitment and performance of conventional cartridge seal designs if used on large slurry pumps that have an axially adjustable shaft, wherein the inventive mechanical seal is installed from the pump wet end and maintains all advantages of a cartridge seal. The basic concept involves rigidly mounting stationary or non-rotatable gland components to the bearing housing and mounting the seal rings and associated gland components to the shaft wherein the seal rings and associated gland components are movable axially with both the shaft and the associated bearing assembly during impeller adjustment. A secondary seal is formed between the stationary and movable gland components to allow for this axial shaft adjustment.

The seal rings and associated seal faces are integrated into a single shaft sleeve wherein the single shaft sleeve eliminates a sleeve on sleeve arrangement that typically is used in the currently available slurry seals. Providing this seal face and shaft sleeve arrangement also reduces the seal face diameter. The seal sleeve of the invention preferably has the same ID, end dimensions, and face seals as the OEM shaft sleeve it will replace. This eliminates a seal locking collar which serves to eliminate problematic seal sleeve to pump sleeve galling that often occurs during installation, removal, and during periodic impeller adjustments of the known slurry pumps, as well as galling that results from slurry jamming into close diametrical fits between the sleeves. Eliminating a locking collar avoids resultant limitations on test pressure, and also reduces overall length.

In the inventive cartridge seal, a stationary housing or seal adapter mounts to the pump casing and includes an adapter ring that sealingly contacts the movable gland wherein setting plates preferably locate the gland to the shaft sleeve both concentrically and axially within the axial tolerance of the shaft relative to the bearing housing. The seal adapter or stationary housing and cooperating gland are cylindrical which eliminates a conventional cartridge flange and allows for a reduction in the size of these components so as to fit through the pump's wet end back liner. The adapter ring preferably pilots on or aligns with the gland and is not piloted to the pump interface which allows the adapter ring and associated seal adapter to mount to the pump casing when piloted to the gland which thereby accommodates large concentric pump misalignments that is common on these pumps. For example, these misalignments may be about 0.25 inches in TIR on the HTP 600 pump.

A static or stationary gland gasket is disposed on the seal adapter and is captured by an associated end plate that mounts to the adapter ring so that the gasket sealingly contacts the movable gland. The static gasket provides a static seal between the movable seal gland and the seal adapter by tightening bolts on the end plate to thereby compress the gasket between the end plate and adapter ring and squeeze the gasket into improved sealing contact with the movable gland. Axial movement of the shaft during impeller adjustment is accommodated via the static gasket which contacts the OD of the movable gland, which is axially-shiftable, wherein the static gasket preferably projects radially inwardly from the opposing ID surface of the seal adapter and the adapter ring thereof and thereby projects toward the OD of the movable gland. This axial shaft adjustment can be made easier by reducing compression of the static gland gasket through loosening or removing the end plate and static gasket if desired, although gasket decompression or removal may not be required.

Conventional cartridge mechanical seals do not satisfy the requirements of large high pressure slurry pumps practically, reliably, or realistically. However, the improved mechanical seal accommodates the challenging conditions typically encountered on these large, high pressure slurry pumps and provides other advantages relating to installation, removal, preventive maintenance, field replacement of the primary seal, and operation as described in further detail below.

More particularly, the improved mechanical seal of the invention preferably provides various advantages over prior mechanical seals. The advantages include:

1. Seal cartridge weight is minimized by eliminating a large diameter gland flange which are used in smaller scale cartridge seals, which is a particular advantage since the gland will have approximately a 27 in. diameter on the known HTP pumps.

2. Eliminating the existing seal sleeve in the known pumps minimizes seal face insert size.

3. Galling of the seal sleeve to pump sleeve and/or setting plates due to required shaft rotation during impeller installation, removal, and clearance adjustments is eliminated in the improved mechanical seal. The improved seal is designed to permit periodic impeller adjustments to accommodate impeller life of 2000 to 3000 hours with periodic impeller axial adjustments up to 2.5 in. every 1000 hours of operation.

4. Improved run-out of rotating seal parts by eliminating clearance and tolerance between sleeves.

5. Seal removal is facilitated by eliminating migration of packed slurry between conventional seal sleeve and pump sleeve on the process fluid side as well as atmospheric side due to both normal and failure leakage. The inventive seal sleeve is sealed on the axial facing ends which thereby isolates the shaft fit from slurry and allows liberal grease to be used between the shaft and shaft sleeve for ease of installation and removal of the inventive seal.

6. The inventive seal design requires less customer/user knowledge and skill to install the mechanical seal on the shaft when compared to conventional mechanical seals on slurry pumps. Subsequent impeller adjustments do not affect seal setting or seal face wear track alignment.

7. A seal sleeve locking or clamp collar engaging the pump shaft is eliminated which is problematic in slurry applications due to dirt, grease, and galling between the sleeves wherein the locking collar can slip during operation or else gall during seal installation because lubrication is not permitted with a clamp collar. Where a locking collar is used, repositioning is required for subsequent impeller adjustments. Also, hydrostatic test pressures are typically limited by the locking collar clamping force, but such limitations are avoided in the inventive cartridge seal.

8. Wet end design wherein the inventive seal is installed on the shaft from the wet end which thereby serves to ease installation and removal.

9. The inventive seal uses a non piloted centering, seal adapter which is located by the seal gland outside diameter and is centrically located to the seal/pump sleeve via setting plates on each end of the seal to thereby accommodate large non-concentric seal adapter alignment.

10. The seal adapter static gasket in the inventive design preferably is an O-ring and is compressed and sealed to the seal gland outside diameter after impeller installation and adjustment is complete, wherein the gasket is a packed gasket and uses an O-Ring end plate and bolts to effect compression. The gasket compression can be released during subsequent impeller adjustments and the annular gasket could be replaced with a new one that is separated at one location for installation and then glued together at the free ends to reform the continuous annular ring shape.

11. Periodic impeller adjustments do not affect the seal setting.

12. Affords maximum utilization of axial space in the pump seal cavity for double seal outboard seal selection and impeller adjustments.

13. Primary seal faces are shrouded from impact by large slurry particles by a tapered gland extension that moves with the seal ring and movable gland and thereby maintains an axial position relative to the seal rings throughout the 2.5 in. axial impeller adjustment range.

14. Seal cavity geometry is maintained between the impeller hub, seal rotating assembly, which comprises the seal rings and movable gland, and the tapered gland extension that is exposed to process slurry, wherein the seal cavity geometry is maintained throughout the 2.5 in. axial shaft position. This geometry controls and impedes erosion of metal parts and serves to shroud the inboard seal faces from the impact of large slurry particles. With conventional cartridge designs, the seal remains stationary if the shaft is moved axially, such that 2.5 in. of axial shaft movement would increase the gap between the seal and impeller creating a high erosive vortex and exposing the seal faces and pump shaft to impact and erosion by larger slurry particles.

15. The improved seal design facilitates a complete replacement (repair) of the high wear primary seal components during impeller replacement without requiring removal of the complete seal from the pump or disturbing seal adjustment which thereby facilitates economic preventive maintenance. In this regard, orbital shaft movement of up to 0.1 in. TIR typical will cause high primary seal face wear at the outside diameter seal interface by wiping slurry into the seal face OD every revolution. Pump and system operating factor will be increased by eliminating catastrophic seal failures which typically cause pump system water hammer and other equipment damage from an emergency system shut down.

16. The stationary or non-rotatable seal components, including the movable gland, are mounted rigidly to the bearing housing so as to move therewith during axial shaft adjustment. Rigid mounting of the seal stationary components to the bearing housing thereby corrects axial setting of these components and eliminates installer discretion. The seal setting is not affected by pump casing movement caused by casing pressure expansion, or piping strain, which can be problematic in large slurry pumps. Axial, angular, and to some degree concentric movement is accommodated by the static gland gasket and does not affect alignment of the rotating seal components with the stationary gland components.

17. Plan 54 & 32 barrier piping is permanently mounted to a stationary clamp ring that is used to mount the movable gland and bearing housing together. The clamp ring has sealed ports which communicate with the gland for supplying fluid to the seal gins. Removal is not necessary for seal installation and replacement.

18. The seal design economically accommodates a single seal design utilizing the same adaptive hardware by simply changing the sleeve and components of the movable gland.

19. An installation tool is designed to facilitate field installation and removal which will include a weight centered lifting lug and include a bolted attachment to the pump shaft end.

Therefore, the inventive mechanical seal provides a cartridge seal design to large scale, high-wear pumps, and provides significant advantages as discussed herein.

Other objects and purposes of the invention, and variations thereof, will be apparent upon reading the following specification and inspecting the accompanying drawings.

BRIEF DESCRIPTION OF THE DRAWING FIGURES

Figure 1:
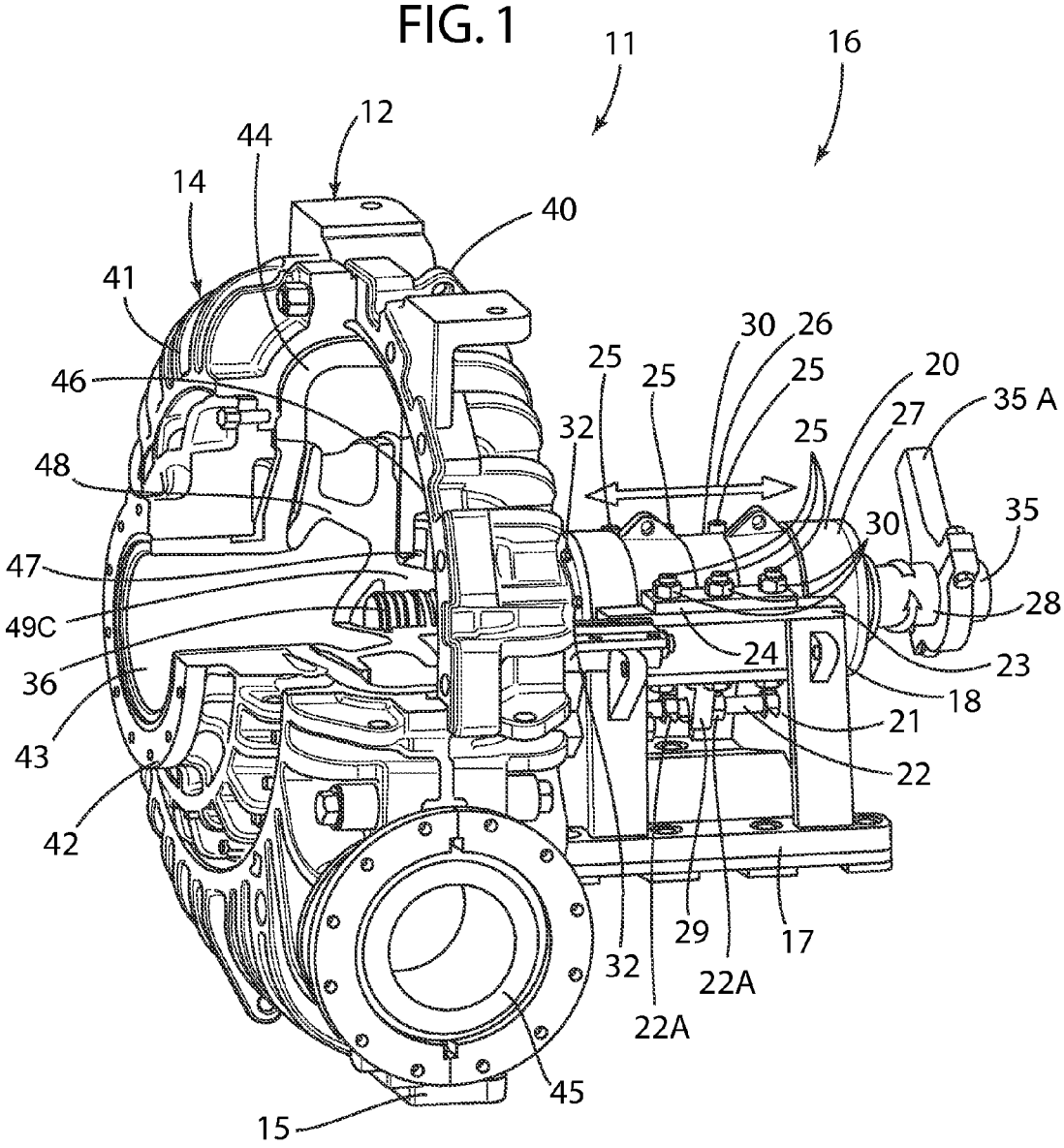
FIG. 1 is a cut away perspective view of a pump used in association with the present invention.

Certain terminology will be used in the following description for convenience in reference only and will not be limiting. The words "up", "down", "right" and left" will designate directions in the drawings to which reference is made. The words "in" and "out" will refer to directions toward and away from, respectively, the geometric center of the device and designated parts thereof. The words "proximal" and "distal" will refer to the orientation of an element with respect to the device. Such terminology will include derivatives and words of similar import.

DETAILED DESCRIPTION OF THE PREFERRED EMBODIMENT

Figure 2:
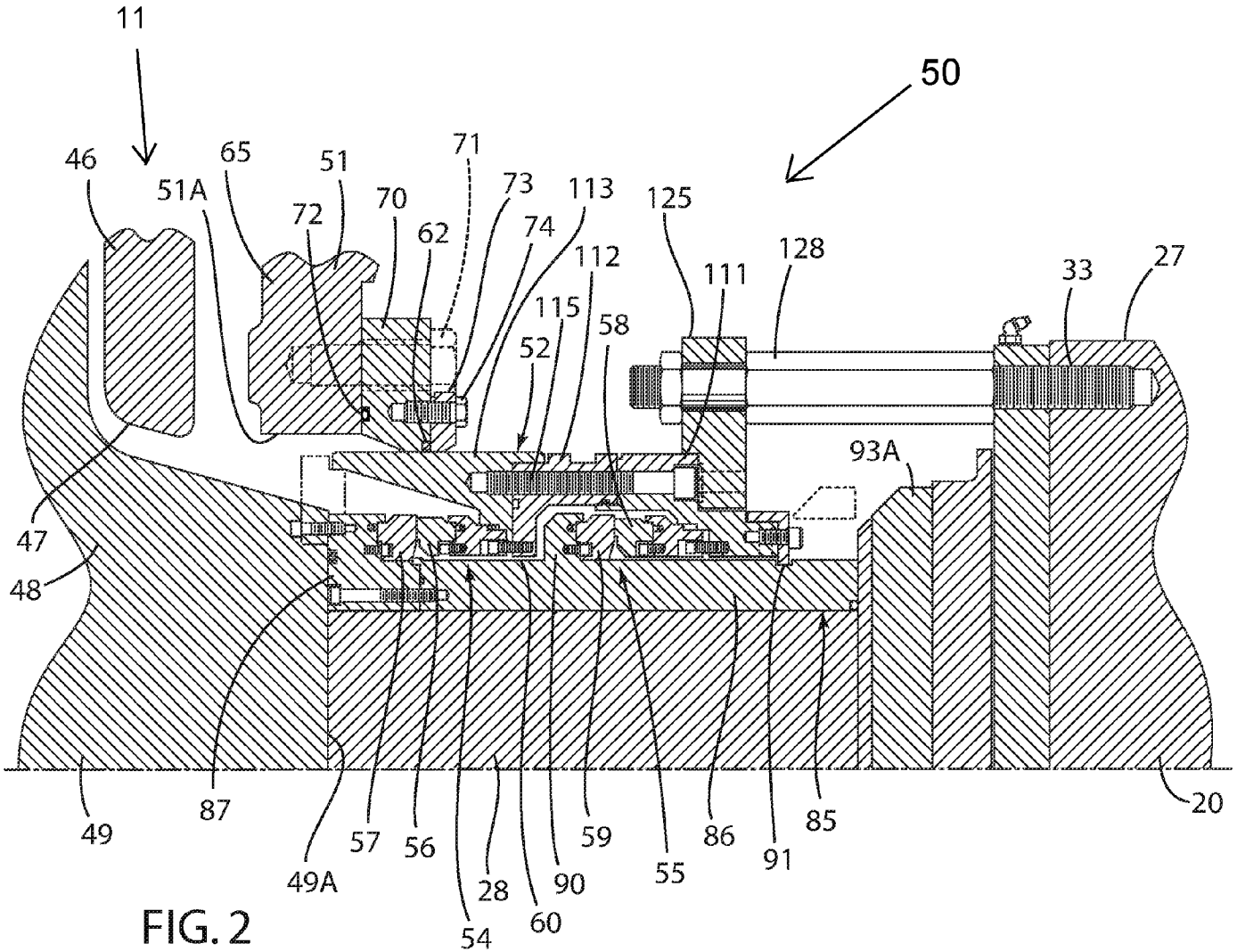
FIG. 2 is a cross sectional view through a first section illustrating a mechanical seal of the invention mounted on a shaft in an initial position.

Referring to FIGS. 1 and 2, the invention relates to a mechanical seal assembly 50 (FIG. 2) preferably constructed as a cartridge seal for use in large high pressure pump units 11 (FIGS. 1 and 2), which pump units 11 typically encounter high wear in use.

Pumps for these large scale applications, such as the Weir HTP 500 and 600 pumps, are developed for various high pressure applications which may encounter high wear such as hydro transport and tailings slurries. The mechanical seal 50 of the invention is disclosed in combination with a Weir HTP-600 pump 12 illustrated in FIG. 1.

The pump 12 is a commercially available pump and the specific construction of such is not disclosed in detail herein. Generally, the pump unit 11 comprises the pump 12 that has an outer pump casing 14 supported on a pump base 15, and further comprises a bearing unit 16 which is supported in a fixed position adjacent the casing 14 by its respective bearing base 17. The base 17 of the bearing unit 16 includes an upward-opening cradle 18 which adjustably or movably supports a shaft-supporting bearing assembly 20 therein.

The cradle 18 is generally U-shaped to receive the bearing assembly 20 and includes an adjustment plate 21 at one end that supports an adjusting screw or bolt 22 that extends axially therethrough. The cradle 18 includes upper shoulders 23 on opposite sides of the cradle 18 which support a pair of clamp pads or plates 24 that vertically receive threaded studs 25 projecting upwardly from the shoulders 23. The bearing assembly 20 is generally cylindrical and seats in the cradle 18 in a selected axial position, wherein the position of the bearing assembly 20 in the cradle 18 may be adjusted axially as indicated by reference arrow 26 to accommodate wear in the pump casing 14 as will be discussed hereinafter. In this regard, the bearing assembly 20 includes a bearing housing 27, which has bearings therein that rotatably support the pump shaft 28, and includes a downwardly projecting adjustment lug 29 that is engaged by the adjusting screw 22. Rotation of one or the other of adjusting nuts 22A on the screw 22 axially drives the lug 29 and the associated bearing housing 27 toward and away from the pump casing 14. Due to the large size and weight of the bearing assembly 20, the adjusting nuts 22A allow for easier displacement of the bearing assembly 20 within the cradle 18.

After positioning the bearing assembly 20, the bearing assembly 20 is immovably fixed in position by placing the two clamp pads 24 on their respective studs 25 and then respective nuts 30 are threaded in place. The clamp pads 24 have inner edge portions that engage with the bearing housing 27 and prevent movement of the bearing assembly 20 when the nuts 30 are seated tightly. While the bearing assembly 20 is located in an initial position, the pump 12 is expected to encounter significant wear of its interior components which diminishes pump performance. While worn components will eventually require replacement, the bearing assembly 20 and the shaft 28 can be adjusted axially during pump maintenance to restore some lost performance and maximize the life of the pump components before replacement thereof is required.

As seen in FIG. 1, the bearing housing 20 also includes a plurality of circumferentially spaced end bolts 32 that are spaced at equal angular distances from each other. The bolts 32 seat within threaded bores 33 (FIG. 2) so that the bolt heads of bolts 32 seat against the end face of the bearing housing 20 as seen in FIG. 1. While the bolts 32 are all the same in the conventional construction of the pump 12, the seal 50 (FIG. 2) of the invention mounts to and is supported on the bearing housing 20 by removal of a select number of such bolts 32 which allows the exposed bores 33 to be used for mounting of the seal assembly 50 as will be discussed further herein. Hence, the seal assembly 50 can be installed within existing pumps as a replacement to the existing seal designs which have the significant disadvantages associated therewith.

Referring to FIG. 1, the afore-mentioned shaft 28 is horizontally elongate and has an outboard end 35 which is exposed for connection to a motor or other driving means. During installation and servicing of the pump 12, it may be necessary to mount a large driver 35A for rotation of the shaft 28 in opposite rotational directions. The inboard shaft end 36 extends into the interior of the pump casing 14 and is threaded for supporting an impeller 48 thereon.

For purposes of scale, it will be understood that the bearing unit 16 has a height close to the height of the average adult, and the pump casing 14 is substantially higher than that. The weight of these components is therefore substantial and the scale and operational challenges associated with these pumps 12 is much greater than those encountered with small scale pumps and other similar equipment.

Further as to the pump 12, the pump casing 14 is formed as three parts comprising a casing frame plate 40 which is formed with the base 15 and defines one half of the casing 14. Secondly, the casing 14 includes a removable cover plate 41 having a similar size and shape which mates with the frame plate 40 to define the hollow interior of the casing 14. The end wall of the cover plate 41 has a circular opening to which is mounted a suction cover 42, wherein the suction cover 42 is configured to support a cylindrical throat bush 43 that defines the inlet of the pump chamber. The pump casing 14 also includes a generally donut-shaped hollow volute liner 44 which defines the pump chamber and includes an outlet passage 45.

An open side of the volute liner 44 that is opposite the throat bush 43 also includes a disc-like frame plate liner insert or back wear liner 46. The liner insert 46 has a circular opening 47 through which the threaded shaft end 36 extends into the interior of the volute liner 44.

To effect pumping, the impeller or rotor 48 is threadedly mounted to the shaft end 36. In particular, the impeller 48 has a mounting hub 49 which includes an internally threaded bore 49C (FIG. 1) which opens axially through a hub end face 49A (FIG. 2) for receiving the shaft end 36. During installation, a lifting beam is used to suspend the impeller 48 adjacent the shaft 28, and the shaft 28 is then rotated to thread the shaft end 36 into the hub bore 49C and draw the impeller 48 axially into threaded engagement with the shaft end 36. The suction cover 42 and throat bush 43 can then be reinstalled.

Continuing with initial installation, the end face of the shaft-mounted impeller 48 is positioned closely adjacent the opposing interior face of the throat bush 43 as seen in FIG. 1. This is accomplished by slowly rotating the shaft 28, preferably with the driver 35A, while simultaneously using the adjusting nuts 22A and bearing lug 29 to axially displace the bearing assembly 20 and shaft 28 toward the suction cover 42, and thereby move the slowly rotating impeller 48 until it rubs against the throat bush 43. The adjusting nuts 22A are then used to withdraw the impeller 48 a fraction of a centimeter away from the throat bush 43 to preferably define a small clearance space therebetween. The bearing assembly 20 is then clamped in position by the clamp pads 23 which maintain the shaft 28 and its interconnected impeller 48 in the selected position during pump operation.

After a period of time, the impeller 48 undergoes wear from the abrasiveness of the fluid being pump, which thereby increases the clearance space between the impeller 48 and throat bush 43 and negatively degrades the performance of the pump 12. Typically after about 1000 hours of operation, the impeller 48 is adjusted to improve performance by axially adjusting the impeller 48 back towards the throat bush 43. This is accomplished in the same manner described above by loosening the clamp pads 23 and using the adjusting nuts 22A to axially adjust the shaft 28 and impeller 48 to reset the desired impeller/throat bush clearance space.

While this pump construction is commercially available, these pumps have used a stuffing box and packing rings packed into the stuffing box chamber to attempt to seal process fluid being pumped by the rotating impeller 48 from leaking along the shaft 28 through the opening 47 in the liner insert 46. This has significant disadvantages and problems as previously described herein.

The invention therefore relates to an improved mechanical seal assembly 50 (FIGS. 2-4) preferably formed as a cartridge seal. The seal assembly 50 preferably is used with a stationary housing or seal adapter 51, which is provided with the pump 12 and is mounted to the pump casing 14, and includes an adapter ring 70 mounted to the seal adapter 51 and a movable gland 52 which supported on the bearing assembly 20 so as to move axially with the bearing housing 27 and shaft 28 but is non-rotatable relative to the shaft 28 during the rotation thereof. The seal assembly 50 in the illustrated embodiment includes two sets 54 and 55 of relatively rotatable seal rings 56/57 and 58/59, which have opposed seal faces that define sealing regions extending radially along the opposed seal faces. The seal ring sets 54 and 55 comprise stationary or non-rotatable seal rings 56 and 58 which are non-rotatably supported on the gland 52 and move axially therewith during impeller adjustments. The other seal rings 57 and 59 are mounted to the shaft 28 by a shaft sleeve 85 so as to rotate with the shaft 28 during driving operation of the impeller 48. A radial spacing 60 is defined between the gland 52 and shaft sleeve 85 to define a seal chamber in which the seal rings 56/57 and 58/59 are located. The shaft sleeve 85 and rotatable seal rings 57 and 59 also move axially in unison with the shaft 28, the bearing housing 20 and the gland 52 with its non-rotatable seal rings 56 and 58. All of these components move axially together during impeller adjustment.

However, the adapter ring 70 remains stationary and does not move axially since it is connected to the pump casing 14. Axial movement of the shaft 28 during impeller adjustment is accommodated via a static gasket 62 which sealing contacts the outer diameter (OD) of the movable gland 52 which is axially-shiftable, wherein the gasket 62 preferably projects radially inwardly toward the OD of the movable gland 52. This defines a secondary seal between the movable gland 52 and the adapter ring 70 that permits the axial or sliding movement of the gland 52 relative to the seal adapter 51 while preventing leakage of process fluid between these relatively slidable components.

Figure 3:
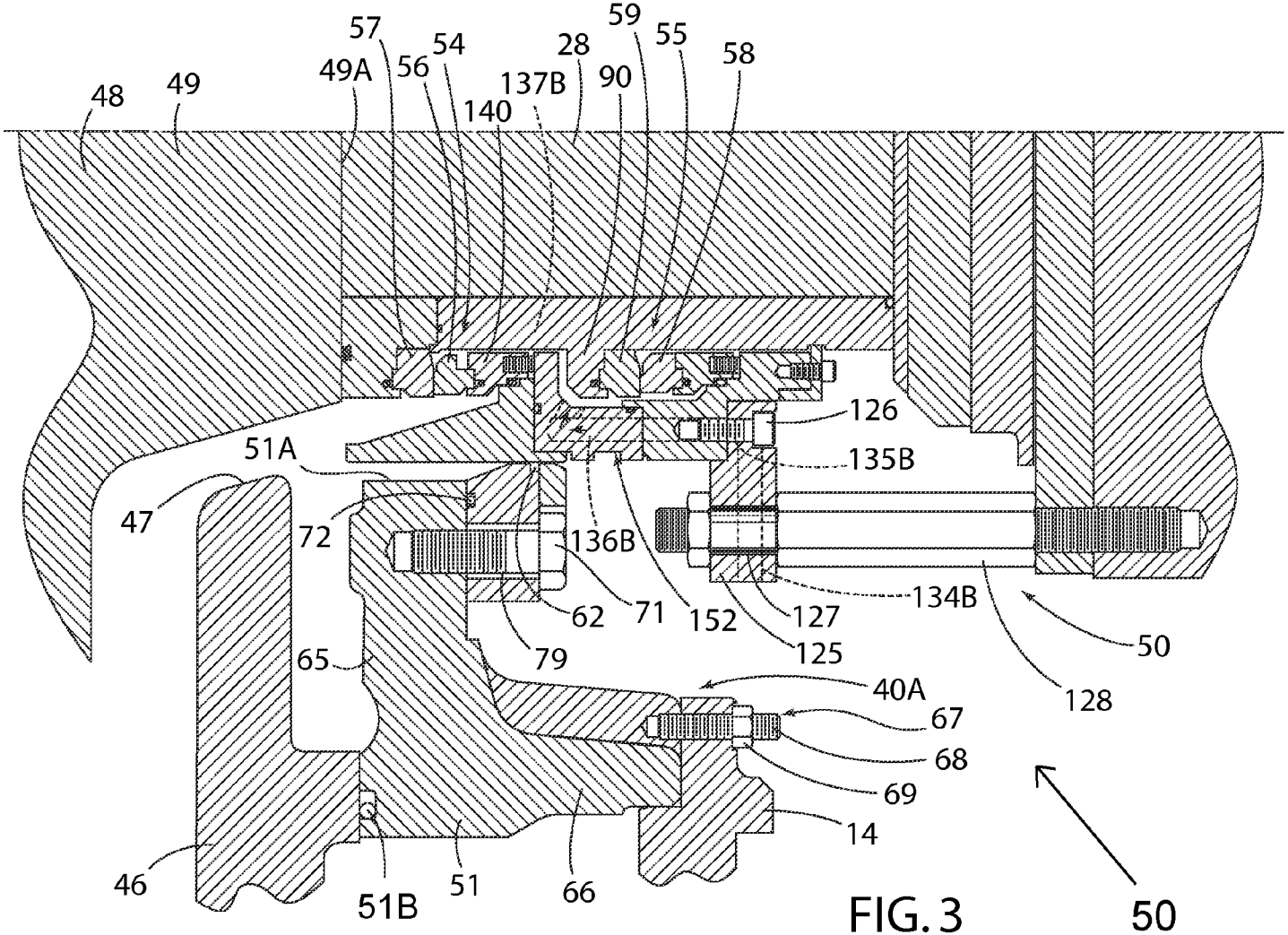
FIG. 3 is a cross sectional view through a second section taken 180 degrees from the first section and illustrating the seal and shaft in an adjusted position displaced axially from said initial position.

More particularly as to the seal construction, seal adapter 51 (FIGS. 2-4) is generally disc-shaped and has an adapter end wall 65 which is bounded on its periphery by a circumferential side wall 66. The seal adapter 51 is disposed on the interior of the casing frame plate 40 so as to partially enclose a circular opening 40A defined in such frame plate 40. The seal adapter 51 similarly includes an adapter opening 51A but has a diameter smaller than the frame plate opening 40A as best seen in FIG. 3. The seal adapter 51 is immovably secured in position on the frame plate 40 of the pump casing 14 by a plurality of fasteners 67. These fasteners 67 preferably comprise threaded studs 68 engaged with the adapter side wall 66 and nuts 69 engagable therewith, wherein the fasteners are angularly spaced about the circumference of the adapter side wall 66.

During pump installation and servicing, the frame plate 40 and bearing unit 16 can remain stationary on their respective bases 15 and 17, while the suction cover 42, throat bushing 43, impeller 48 and liner insert 47 can be installed and removed sequentially one after the other through the open side of the pump casing 14 that is created after removal of the suction cover 42. In this manner, the wet end 36 of the shaft 28 is exposed and the entire mechanical seal assembly 50 can be mounted on or dismounted from the shaft 28 through the open casing side.

Due to the substantial size and weight of all of these components, a lifting beam is used, which hangs downwardly from the hook of a crane and has various mounting arms to temporarily secure the pump components to the lifting beam and then allow for positioning of each component in its desired location until appropriate fasteners are installed or removed respectively during installation and removal of the pump components. The mechanical seal assembly 50 preferably is formed as a cartridge seal that is mounted to the shaft 28 as an assembled unit and then is captured on the shaft 28 by installation of the impeller 48 and also connected to the bearing assembly 20 by additional connector structure as will be described further herein.

The seal adapter 51 is installed and fastened to the frame plate 40 of the pump casing 14 by the fasteners 67, and typically remains installed during servicing. Then, the liner insert 46 is installed with opposing faces of the frame plate 40 and liner insert 46 sealed by a O-ring shaped gasket 51B (FIG. 3). Referring to FIG. 2, the impeller 48 is then positioned adjacent to the threaded shaft end 36 (FIG. 1) and the shaft 28 is rotated slowly as described above to draw the impeller inwardly until the threaded shaft end 36 is threaded into the corresponding open-ended hub bore in the impeller hub 49 and the impeller 48 contacts the shaft sleeve 85. This wet end design for the cartridge seal 50 provides advantages wherein the inventive seal assembly 50 is installed on the shaft 28 from the wet end 36 which thereby serves to ease installation and removal of the pump components and the components of the inventive seal assembly 50. Periodic impeller adjustments will be performed to accommodate a typical impeller life of 2000 to 3000 hours with periodic impeller axial adjustments of up to 2.5 in. possibly being encountered every 1000 hours of operation.

Figure 4:
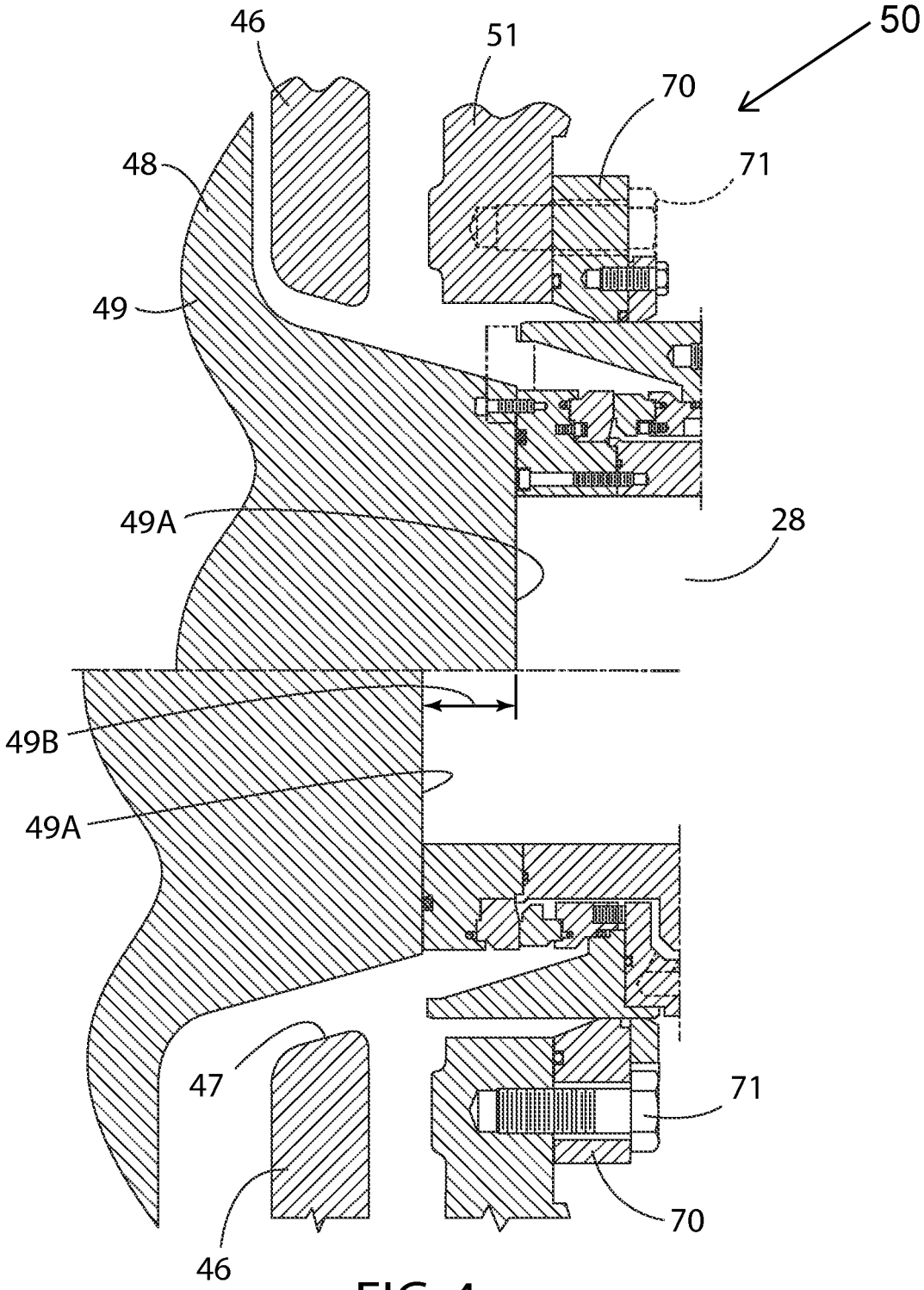
FIG. 4 is a cross sectional view of the wet end of the shaft and seal partially showing the cross sections of FIGS. 2 and 3.

FIG. 2 illustrates the impeller 48 in an initial position after completed installation, wherein there is an initial spacing between the impeller surfaces and the opposing surfaces of the other pump components such as the end liner 46, and the seal adapter 51. However, as previously described, the impeller 48 is subjected to wear during use, and periodically, the impeller 48 is adjusted axially, wherein FIG. 3 illustrates the impeller 48 in an adjusted position displaced leftwardly in comparison to FIG. 2. FIG. 4 comparatively illustrates the impeller positions one above the other, wherein it should be noted that the end liner 46 and seal adapter 51 remain stationary during the shaft adjustments but the impeller end face 49A is displaced axially as indicated by reference arrow 49B. Therefore, during shaft adjustment, the impeller 48, shaft 28, bearing assembly 20 and many of the components of the mechanical seal assembly 50 move together in unison as is readily apparent from FIGS. 2-4.

To permit this adjustment, the mechanical seal assembly 50 comprises components, which maintained stationary by mounting to the pump casing 14, and additional components, which are axially movable with the shaft 28, wherein a secondary seal is defined between the stationary and movable components to prevent fluid leakage of the process fluid, while permitting the axial movement between these components.

As to the stationary seal components, the seal assembly 50 comprises an adapter ring 70 (FIGS. 2-4) which mounts to the seal adapter 51 by a plurality of bolts 71 and surrounds the gland 52. An O-ring gasket 72 is pressed between the adapter ring 70 and seal adapter 51 to prevent fluid leakage therebetween.

Figure 5:
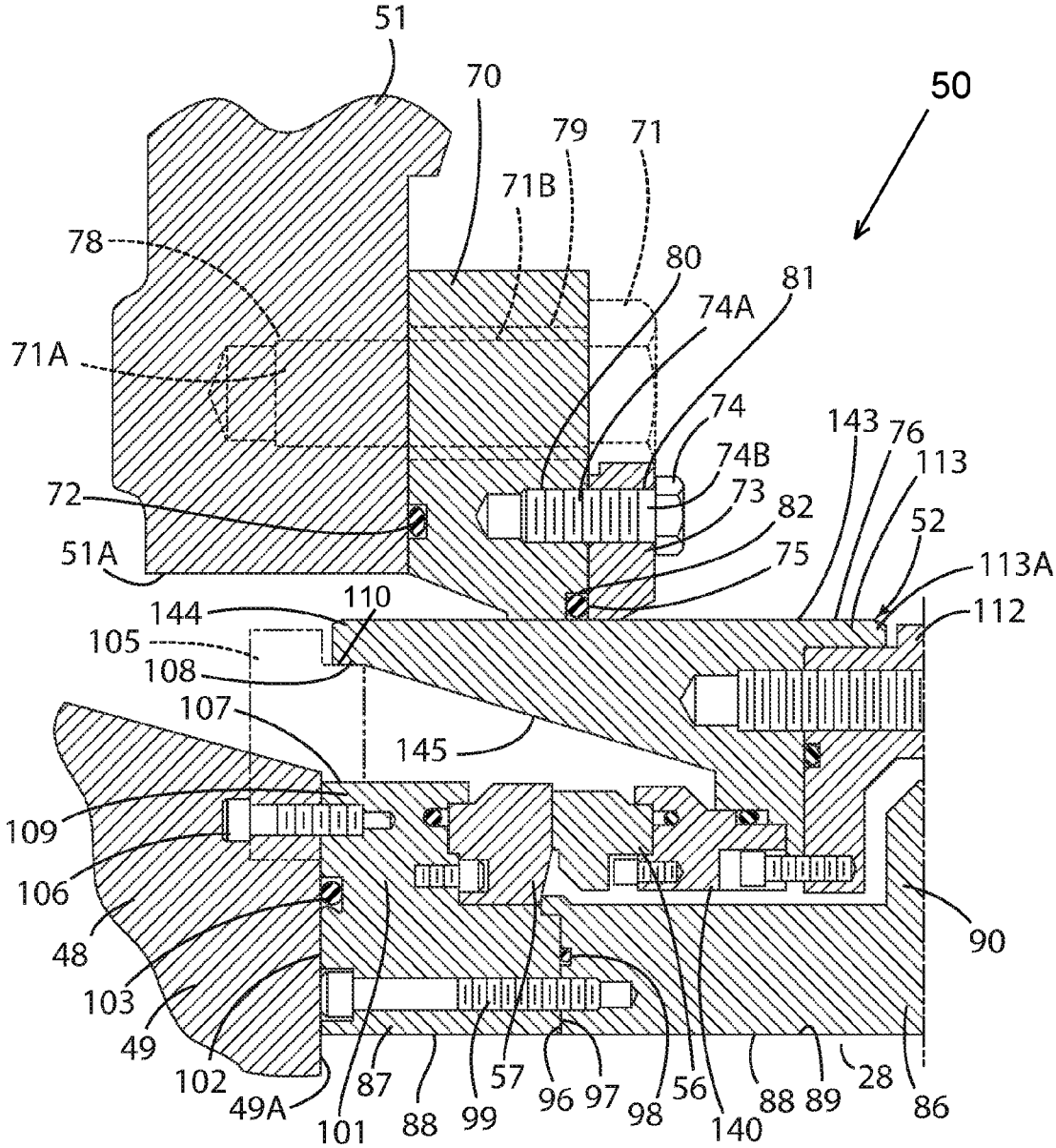
FIG. 5 is an enlarged partial view showing the inboard wet end of FIG. 2.

To seal the OD of the gland 52, the adapter ring 70 is provided in combination with an end plate 73 which is fastened to the adapter ring 70 by fasteners 74, and compresses a seal adapter gasket 75 that remains stationary in a static position. The static gasket 75 is compressed between the end plate 73 and adapter ring 70 so as to project radially inwardly a small distance and sealingly contact the movable seal components, and in particular, the movable seal gland 52. As best seen in FIG. 5, the seal adapter gasket 75 preferably is an O-ring defining a static gasket that is compressed and sealed to the outside diameter (OD) 76 of the seal gland 52 after impeller installation and adjustment is complete, wherein the gasket 75 is a packed gasket and uses the end plate 73 and bolts or fasteners 74 to effect compression thereof. The gasket compression can be released during subsequent impeller adjustments and the gasket 75 could be replaced with a new one that is separated at one location along its length for installation and then glued together at the free ends to define a continuous annular O-ring.

More particularly as to FIG. 5, the seal adapter 51 and adapter ring 70 are non-piloted which allows for radial variation of the position of the adapter ring 70 relative to the seal adapter 51 so as to accommodate variations in the radial position of the shaft 28, or gland 52. In this regard, each of the bolts 71 has its free end 71A threadedly engaged within a respective bore 78 that is formed in the end face of the seal adapter 51. The bore 78 is a threaded blind bore which opens sidewardly.

The adapter ring 70, however, has oversized through bores 79 which are larger than the diameter of the shank 71B of the bolt 71 so that a radial clearance is provided in the through bores 79, and the adapter ring 70 has some freedom of radial movement relative to the bolts 71 prior to final tightening. The bolt shank 71B passes loosely through the through bore 79 wherein the radial position of the adapter ring 70 is dictated by the radial position of the gland 52, which is in contact with the adapter ring gasket 75, and also by the radial position of the shaft 28 due to setting plate features connected between the gland 52 and shaft 28 as will be described further herein. As such, the seal adapter 51 and adapter ring 70 are able to accommodate large non-concentric alignments in the seal adapter structures. Once the radial position of the adapter ring 70 is set, the bolts 71 are then tightened to preferably fix the radial position.

As to the end plate 73, the end plate bolts 74 have a free end 74A which is threadedly engaged with a blind bore 80 in the adapter plate 70. The bolt shank 74B passes through a through bore 81 formed in the end plate 73 and the bolts 74 are tightened to compress the static gasket 75 within an undersized pocket 82 and squeeze same radially inwardly towards the OD 76 of the axially-movable gland 52 for sealing contact therewith.

The gasket 75 provides a static seal between the gland 52 and the seal adapter 51 and adapter ring 70 by tightening bolts 74 to increase the radially-directed sealing contact with the movable gland 52. Axial movement of the shaft 28 during impeller adjustment is still accommodated via the static gasket 75 which permits axial movement of the gland 75 while preserving the secondary seal therebetween. This axial shaft adjustment can be facilitated by reducing compression of the static gland gasket 75 through loosening or removing the end plate 73 and static gasket 75 if desired, although this is not required for axial shaft adjustment.

As to the axially-movable seal components, the seal components are either supported on the shaft 28 for rotation therewith, or on the gland and bearing assembly 20 so as to be non-rotatable or stationary relative to the shaft rotation. The shaft-mounted components comprise a shaft sleeve 85 which is slid onto the shaft 28 and supports the rotatable seal rings 57 and 59 thereon. The shaft sleeve 85 preferably comprises a main sleeve body 86 and an end sleeve body 87 which attaches to the inboard, wet end of the main sleeve body 86. As seen in detail in FIGS. 5 and 6, the main sleeve body 86 has an inner diameter (ID) 88 which closely fits onto the outer diameter (OD) 89 of the shaft 28 so that the shaft sleeve 85 can be slid onto the shaft 28 during installation. The main sleeve body 86 has a radial thickness which is selected so as to eliminate the sleeve on sleeve design used in the commercial HTP pump, which provides advantages as discussed above. In this regard, improved run-out of rotating seal parts is achieved by eliminating clearance and tolerance between sleeves.

Further, a radially projecting backing flange 90 is provided which supports the rotatable seal ring 59 by a suitable drive pin connection to effect rotation of the seal ring 59. The outboard sleeve end also has a setting groove 91 (FIG. 6).

Figure 6:
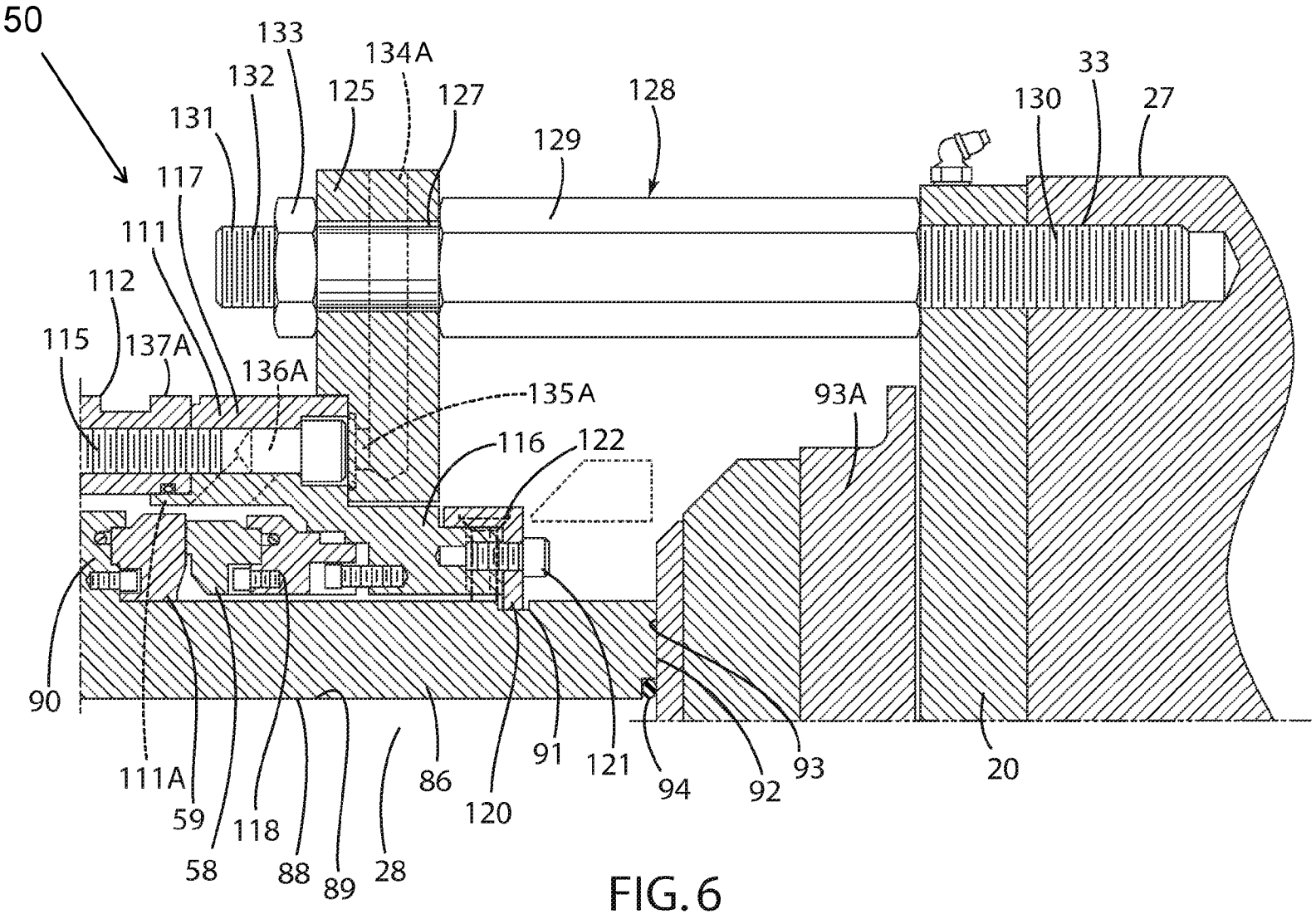
FIG. 6 is an enlarged partial view showing the outboard end of FIG. 2.

To axially locate the shaft sleeve 85, the main sleeve body 86 has an outboard end face 92 which abuts against an opposing end face 93 associated with the bearing assembly 20 as seen in FIG. 6, wherein the outboard sleeve end is sealed by an O-ring or gasket 94. In the illustrated embodiment, the end face 93 is defined by an impeller release collar 93A which releases compressive loads from the impeller to shaft threads resulting from impeller driving torque.

Referring to FIG. 5, the inboard sleeve end of the main sleeve body 86 has a first end face 96 which abuts against the opposing end face 97 of the end sleeve body 87 wherein this joint is sealed by O-ring 98. The main sleeve body 86 and end sleeve body 87 are rigidly joined together and piloted by fasteners 99, so as to be joined together as a single unit to form the shaft sleeve 85 and maintain the concentricity of these joined components to minimize shaft-to-sleeve clearance. The ID of the end sleeve body 87 forms an extension of the ID 88 described above and therefore allows axial sliding of the shaft sleeve 85 along the shaft OD 89 during sleeve installation for a close fit. Preferably, the opposed surfaces at the sleeve ID 88 and shaft OD 89 preferably are provided with grease to facilitate installation and avoid galling of these surfaces during shaft rotation, which galling can occur when the impeller 48 is being mounted to the shaft 28.

Figure 7:
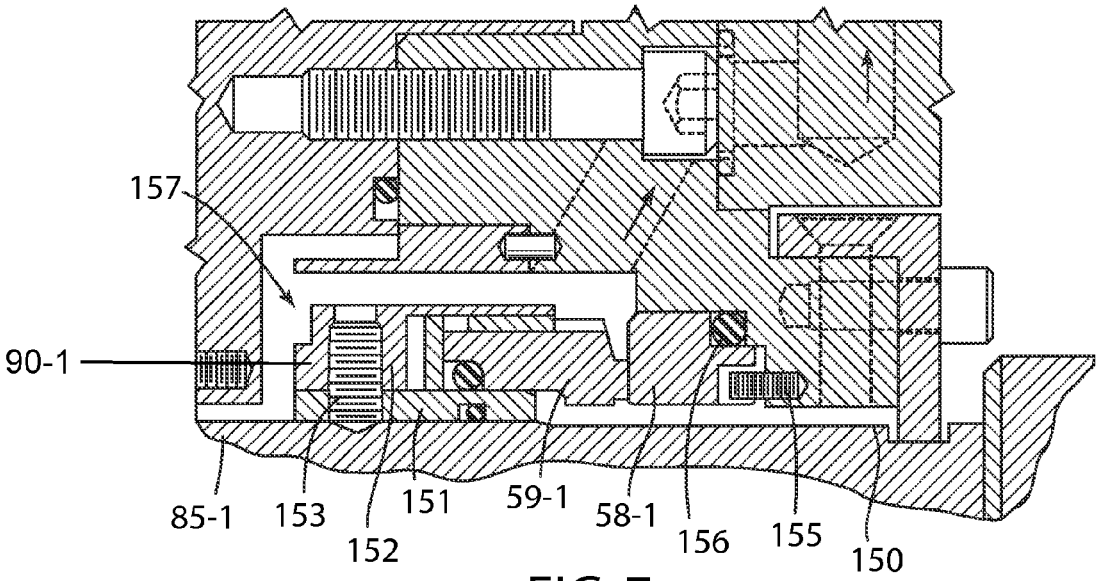
FIG. 7 is a cross sectional view through a first section illustrating a second embodiment of the invention shown in a modifiable double seal configuration.
Figure 8:
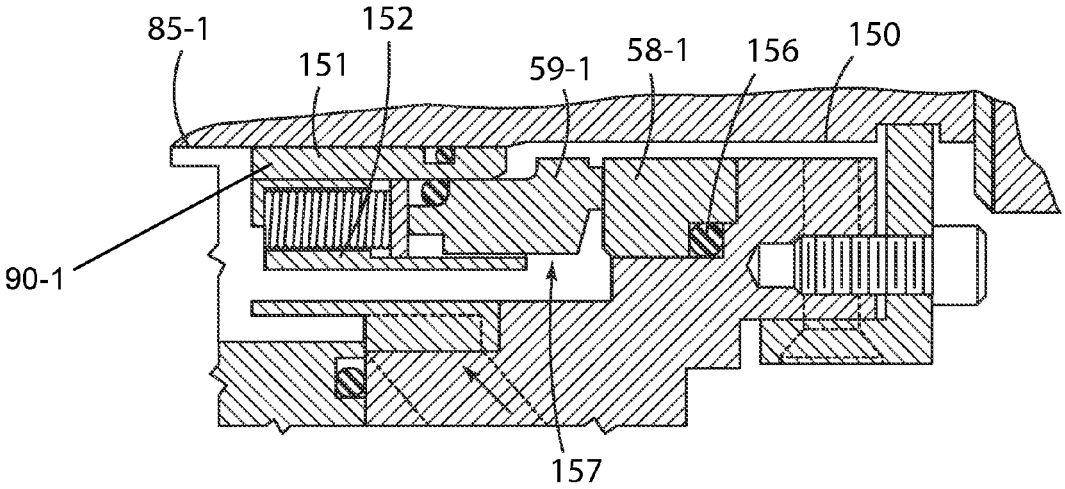
FIG. 8 is a cross sectional view through a second section taken 180 degrees from the first section and illustrating the seal of FIG. 7.

To support the wet-end seal ring 57 on the shaft sleeve 85, the end sleeve body 87 (FIG. 5) has a generally L-shaped cross section to define an inboard backing flange 101 that projects radially outwardly and supports the inboard seal ring 57 so as to drive such seal ring 57 by a drive pin connection. In this illustrated design, the shaft sleeve 85 supports two seal rings 57 and 59 to define a double seal configuration. However, the shaft sleeve 85 may also be formed in a single seal configuration by eliminating one of the seal rings such as by eliminating the backing flange 90 and seal ring 59, so that the remaining seal ring 57 functions in a single seal configuration. This affords maximum utilization of axial space in the pump seal cavity for double seal outboard seal selection and impeller adjustments. The inventive seal design therefore is able to economically accommodate a single seal design using the same adaptive hardware by simply changing the sleeve 85 and components of the movable gland 52. An alternative sleeve configuration is shown in FIGS. 7 and 8 discussed below which allows the same shaft sleeve 85-1 to be modifiable for use in both the double seal configuration of FIGS. 7 and 8 or a single seal configuration wherein selected shaft sleeve components are removed.

To axially locate and confine the shaft sleeve 85, the end sleeve body 87 also includes an inboard end face 102 which abuts against the opposing impeller hub face 49A. A secondary seal is created at this joint by a hub gasket 103 that is preferably formed as an O-ring compressed between the opposed faces 102 and 49A. Once the impeller 48 is threadedly engaged to the shaft 28, the shaft sleeve 85 is pressed axially between the impeller end face 49A and the end face 93 associated with the release collar/bearing. The sleeve/shaft interface at the opposed surfaces 88 and 89 is sealed from process fluids and contaminants by the gaskets 103 (FIG. 5) and 94 (FIG. 6) described. Galling is thereby eliminated at this sleeve/shaft interface which might galling might otherwise occur due to required shaft rotation during impeller installation, removal, and clearance adjustments. The inventive seal sleeve 85 is sealed on the axial facing ends by these gaskets 103 and 94 which thereby isolates the shaft fit from slurry and allows liberal grease to be used between the surfaces 88 and 89 for ease of installation and removal. Seal removal is facilitated in the improved seal assembly 50 since the gaskets 103 and 94 serve to seal the opposite ends of the shaft sleeve 85 and thereby eliminate migration of packed slurry between opposed sleeve and shaft surfaces 88 and 89 on the process fluid side as well as atmospheric side due to both normal and failure leakage.

Since the shaft sleeve 85 is secured to the shaft 28 by confinement between the impeller 48 and bearing assembly 20, the inventive design eliminates the need for a seal sleeve locking or clamp collar engaging the pump shaft which is problematic in slurry applications due to dirt, grease, and galling between the sleeves wherein the locking collar can slip during operation or else gall during seal installation because lubrication is not permitted with a clamp collar. Where a locking collar is used in known pumps, repositioning is required for subsequent impeller adjustments. Also, hydrostatic test pressures are typically limited by the locking collar clamping force, but such limitations are avoided in the inventive cartridge seal 50 where the impeller 48 secures the shaft sleeve 85 both axially in a fixed position while also preventing the shaft sleeve 85 from rotating relative to the shaft 28 during operation.

Since the shaft sleeve 85 is axially fixed on the shaft 28, the sleeve 85 necessarily moves axially with the bearing assembly 20, shaft 28 and impeller 48 so that the axial position of the seal rings 57 and 59 relative to these movable components is not altered. Accordingly, periodic impeller adjustments do not affect the seal setting.

Additionally as seen in FIG. 5, the gland 52 is also fixed radially relative to the shaft sleeve 85 by the provision of temporary setting plates or retainers 105 that are fastened to the sleeve end face 102 by fasteners 106. The setting plates 105 having inner and outer shoulders 107 and 108 that respectively cooperate with an outside corner 109 of the end sleeve body 87 and an inside corner 110 of the gland 52 to radially locate the gland 52 at a fixed radial position relative to the shaft sleeve 85. This maintains the relative radial position of these components during installation, wherein the setting plates 105 are mounted to the cartridge seal 50 during installation and until such time as the adapter ring 70 is tightly bolted in position by the above-described bolts 74. This ensures proper radial alignment of the adapter ring 70 and gland 52 relative to the shaft sleeve 85 and the shaft 28 to which the sleeve 85 is mounted. Prior to mounting of the impeller 48, the setting plates 105 and bolts 106 are removed, and the impeller 48 is then screwed onto the shaft 28 to axially locate and secure the cartridge seal assembly 50 in position.

Next as to the gland 52, the gland 52 preferably is formed of three annular or cylindrical gland sections 111, 112, and 113, which stack axially together as seen in FIG. 2 during assembly of the seal rings 56, 57, 58 and 59, shaft sleeve 85 and gland 52. These gland sections 111, 112, and 113 are joined axially together by a plurality of angularly spaced, axially extending fasteners 115.

The outboard gland section 111 is shown in FIG. 6, and has a setting collar 116 closely surrounding the main sleeve body 86 proximate the setting groove 91, and further has an outer gland wall 117 which is radially spaced from the shaft sleeve 85 to receive and accommodate the seal ring 58 therebetween. The junction between the setting collar 116 and gland wall 117 non-rotatably supports a backing ring 118 while permitting spring-biased axial movement of the backing ring 118. The backing ring 118 in turn supports the seal ring 58, which is biased axially into sealing contact with the rotatable seal ring 59 so that the opposed seal faces of these seal rings 58 and 59 are relatively rotatable to define sealing region therebetween. This is the preferred arrangement for a double seal although the seal ring 58 and backing ring 118 can be eliminated in a single seal configuration.

To radially and axially locate the gland 52, the outboard gland section 111 includes a plurality of setting plates 120 which are circumferentially spaced apart and have a radial leg that extends into the setting groove 91 of the shaft sleeve 85. The radial leg is screwed to setting collar 116 of the gland section 111 by axial screws 121 while an axial leg is screwed to the setting collar 116 by radial screws 122 so that the axial screws 121 and radial screws 122 respectively locate the outboard gland section 111 axially and radially relative to the shaft sleeve 85. However, the setting groove 91 is axially oversized relative to the thickness of the setting plate leg inserted therein, so that some adjustment of the axial gland position is permitted when the gland 52 is connected to the bearing assembly 20 during installation.

To fix the gland section 111 to the bearing housing 27, an annular clamp ring 125 is provided which is fastened to the gland section 111 by angularly spaced fasteners 126 (FIG. 3). The clamp ring 125 projects radially outwardly of the gland section 111 and includes oversized through bores 127 which engage with elongate spacers 128. The spacers 128 have a main body 129 with a hexagonal profile dimensioned similar to a bolt head to permit rotation by a tool, and a first threaded end 130 which threads into one of the pre-existing housing bores 33 described above. This is accomplished for each spacer 128 by removing an existing fastener 32 from its respective bore 33 in the bearing assembly 20 and replacing same with the spacer 128. The spacer 128 still performs the bolting function of fastener 32 due to the shape of the main body 129 while also serving as an elongate connector for joining the gland 52 to the bearing housing 27.

The spacer 128 has a free second end 131 which extends loosely through the through bore 127 and has a threaded end portion 132 that receives a nut 133 thereon so that the clamp ring 125 can be tightly pressed between the nut 133 and main spacer body 129. As such, the spacers 128 and associated nuts 133 fix the axial and radial position of such clamp ring 125 relative to the bearing assembly 20 and cause the interconnected gland 52 to move in unison with the bearing assembly 20 during impeller adjustment. Since the through bores 127 are oversized and essentially non-piloted, the radial position of the gland 52 is still aligned by the setting collar 120 relative to the shaft sleeve 85. Once the nuts 133 are tightened, the gland 52 thereby moves with the shaft 28, and bearing assembly 20. This clamp plate 125 can then remain in position during servicing.

Preferably, a double seal configuration of the mechanical seal 50 includes a barrier fluid at a desired pressure in the chamber defined between the seal ring pairs 54 and 55, wherein the seal 50 is designed to handle a full process pressure of 580 psi in the event of a loss of barrier pressure. In this regard, Plan 54 & 32 barrier piping preferably is permanently mounted to the stationary clamp ring 125 that is used to mount the movable gland 52 and bearing housing 27 together. To connect the piping, the clamp ring 125 has sealed outlet ports 134A and 135A (FIG. 6) which extend radially and then axially and which communicate with axial and radial outlet passages 136A and 137A bored into the gland 52 for discharging barrier fluid supplied to the seal rings. FIG. 3 illustrates the clamp ring inlet ports 134B and 135B and the gland inlet passages 136B and 137B which supply the barrier fluid to the seal chamber. Removal of this piping is not necessary for seal installation and replacement.

Next, the gland 52 has the middle gland section 112 sandwiched between the end gland sections 111 and 113, wherein the middle gland section 112 is located radially by locator flanges 111A and 113A that are formed in the respective gland sections 111 and 113. The middle and inboard gland sections 112 and 113 in turn support a backing ring 140 (FIG. 5) which non-rotatably supports the seal ring 56. As seen in FIG. 3, the backing ring 140 and seal ring 56 are spring-biased for axial movement so that the seal ring 56 sealingly contacts the opposed seal ring 57.

In this manner the seal rings 56 and 58 are non-rotatably supported on the gland 52, while the opposing seal rings 57 and 59 rotate in unison with shaft 28. All of these seal rings 56-59, however, move axially together in unison with the other seal components during impeller adjustment. Rigid mounting of the stationary seal components to the bearing housing 27 thereby corrects axial setting of these components and eliminates installer discretion. The seal setting is not affected by pump casing movement caused by casing pressure expansion, or piping strain, which can be problematic in large slurry pumps. Axial, angular, and to some degree concentric movement is accommodated by the static gland gasket 75 and does not affect alignment of the rotating seal components with the stationary gland components.

To effect the secondary seal between the gland outer diameter 76 and the static gasket 75, the outer diameter 76 is defined by a smooth cylindrical gland surface 143 which extends along the axial length of the inboard gland section 113 so that the static gasket 75 can move smoothly along the axial gland length. The axial gland length provides a significant amount of axial impeller adjustment. This gland surface 143 extends leftwardly as seen in FIG. 5 wherein the gland section 113 terminates at a tapered shroud or gland extension 144. The shroud 144 extends past the seal rings 56 and 57, and defines the above described inside corner 108, which inside corner 108 engages the setting plates 105 to radial locate the shroud 144 and gland section 113 radially outwardly of the shaft sleeve 85. The inside of the tapered shroud 144 is defined by a tapered shroud face 145 which tapers radially outwardly starting from a first edge located outboard of the seal rings 56 and 57 and ending at the inside corner 108.

As such, the primary seal faces defined by the seal rings 56 and 57 are shrouded from impact by large slurry particles by the tapered shroud or gland extension 144. The shroud 144 moves with the seal rings 56 and 57 and movable gland 52 and maintains an axial position relative to the seal rings 56 and 57 throughout the 2.5 in. axial impeller adjustment range as seen in FIGS. 2-4. Hence, the seal cavity geometry is maintained between the impeller hub 48, seal rotating assembly, which comprises the seal rings 56 and 57 and the shaft sleeve 85, and the tapered gland extension 144 that is exposed to process slurry, wherein the seal cavity geometry is maintained throughout the 2.5 in. axial shaft position. This constant geometry controls erosion of metal parts.

Conversely, with conventional cartridge designs, the seal rings remain stationary if the shaft is moved axially, such that 2.5 in. of axial shaft movement would increase the gap between the seal rings and impeller creating a high erosive vortex and expose the seal faces and pump shaft to impact and erosion by larger slurry particles.

As another advantage, the improved seal design facilitates a complete replacement (repair) of the high wear primary seal components associated with the seal rings 56 and 57 during impeller replacement without requiring removal of the complete seal 50 from the pump 12 or disturbing seal adjustment which thereby facilitates economic preventive maintenance. In this regard, orbital shaft movement of less than 0.1 in. TIR typically may cause high primary seal face wear at the outside diameter seal interface by wiping slurry into the seal face OD every revolution wherein such worn components can be replaced during pump disassembly and maintenance through the wet end. This refurbishment of worn components would not require removal of most of the seal components, wherein the seal rings 56 and 57, and the backing ring 140 and its associated parts such as drive pins, springs, and O-rings can readily be changed simply by removing the end sleeve body 87 when the impeller 48 is removed. By easily refurbishing worn components, pump and system operating factor will be increased by eliminating catastrophic seal failures which typically cause pump system water hammer and other equipment damage from an emergency system shut down.

Still further, the inventive seal design requires less customer/user knowledge and skill to install the mechanical seal 50 on the shaft 28 when compared to conventional mechanical seals on slurry pumps. Subsequent impeller adjustments do not affect seal setting or seal face wear track alignment.

To facilitate installation and removal of the cartridge seal assembly 50, an installation tool preferably is provided on the lifting beam which will include a weight centered lifting lug and include a bolted attachment to the pump shaft end.

Based upon the foregoing, it will be understood that the inventive cartridge seal 50 provides improved performance for large high pressure pumps 12 by mounting the adapter ring 70 to the pump casing 14 and providing the adapter ring 70 with the static gasket 75 that sealingly contacts the movable gland 52. The adapter ring 70 preferably pilots on or aligns with the gland 52 and is not piloted to the pump interface which allows the adapter ring 70 and associated seal adapter 51 to mount to the pump casing 14 when piloted to the gland 52 which thereby accommodates large concentric pump misalignments that is common on these pumps.

The static gasket 75 provides a static seal between the movable seal gland 52 and the adapter ring 70 by compressing the gasket 75 into improved sealing contact with the movable gland 52. Axial movement of the shaft 28 during impeller adjustment is accommodated via the static gasket 52.

Preferably, the adapter ring 70 and end plates 73 remain mounted to the pump casing 14 while the clamp ring 125 remains mounted to the bearing assembly 20 such as during servicing. As such, any barrier fluid piping can remain connected. However, the gland 52, shaft sleeve 85 and their associated components such as the seal rings are connected together as a cartridge assembly and can be installed or removed as an assembled unit, which preferably is installed and removed from the wet end.

Conventional cartridge mechanical seals do not satisfy the requirements of large high pressure slurry pumps practically, reliably, or realistically. However, the improved mechanical seal 50 accommodates the challenging conditions typically encountered on these large, high pressure slurry pumps and provides other advantages relating to installation, removal, preventive maintenance, field replacement of the primary seal, and operation as described in further detail below.

In the modified design of FIGS. 7 and 8, the shaft sleeve 85 supports two seal rings like seal rings 57 and 59 to define a double seal configuration. FIGS. 7 and 8 refer to the outboard seal ring as seal ring 59-1 since it has a somewhat modified shape. However, the overall structure and function of seal rings 59 and 59-1 are the same and is less relevant to the modified construction of the shaft sleeve 85-1. As previously described, the above-described shaft sleeve 85 may be formed in a single seal configuration by eliminating one of the seal rings such as by eliminating the backing flange 90 and seal ring 59, so that the remaining seal ring 57 functions in a single seal configuration. However, the modified shaft sleeve 85-1 forms the backing flange 90-1 as a separable component that can be removed from the shaft sleeve body 150. The shaft sleeve body 150 is basically the cylindrical portion of the shaft sleeve 85 with the backing flange 90-1 being removably connected thereto. If the backing flange 90-1 is installed, this supports the seal ring 59-1 adjacent a seal ring 58-1 to define the double seal configuration. If the backing flange 90-1 is removed, the seal rings 59-1 and 58-1 are also removed so that only the inboard seal rings 56 and 57 remain in a single seal configuration.

In one possible design, the backing flange 90-1 can be formed in multiple parts comprising an inner ring 151 and an outer flange portion 152 which are removably mounted to the sleeve body 150 by a connector such as set screw 153. To locate this seal assembly on the sleeve body 150, outer cylindrical surface of the sleeve body 150 preferably includes shallow locator recesses 154 which open radially outwardly and receive the inner end of the set screw 153. In this manner, the seal ring 59-1 is mounted for rotation on the shaft.

By loosening the set screw 153, the backing flange 59-1 can be removed from the sleeve body 150, along with the seal rings 59-1, 58-1 and the associated drive pins 155 and O-ring 156. This leaves the internal outboard chamber 157 empty of seal rings 58-1 and 59-1 so as to define the single seal configuration.

This affords maximum utilization of axial space in the pump seal cavity for double seal outboard seal selection and impeller adjustments. The inventive seal design therefore is able to economically accommodate a single seal design using the same adaptive hardware by simply changing the sleeve 85-1 so as to add or remove components for the outboard containment seal defined by the seal rings 58-1 and 59-1.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A cartridge seal for a pump having a shaft that rotates about a shaft axis and is supported by a bearing assembly that is axially movable with said shaft for adjusting an impeller position, said cartridge seal comprising:

a shaft sleeve which extends axially to define inboard and outboard sleeve ends that respectively define opposite first and second end faces which face axially, said shaft sleeve having an inner sleeve surface facing radially inwardly for close fitting on an outer shaft surface of the shaft;

a cylindrical gland which fits over said shaft sleeve in surrounding relation therewith and defines a radial space between said gland and said shaft sleeve, said gland having an inboard gland end and outboard gland end defining opposite ends of said radial space wherein said outboard gland end has a first setting member engagable between said gland and said shaft sleeve to radially and axially locate said gland relative to said shaft sleeve so that said shaft sleeve and said gland are joinable together prior to mounting on said shaft, said gland having outer and inner gland surfaces which face in radially opposite directions wherein said inner gland surface faces toward said shaft sleeve to define said radial space, second setting members being removably mounted to said inboard ends of said gland and said shaft sleeve, said second setting members maintaining fixed radial separation between said inner gland surface relative to said shaft sleeve;

at least an opposed pair of first and second seal rings defining opposing seal faces, said first seal ring being supported on said shaft sleeve within said radial space so as to rotate with said shaft sleeve and the shaft, and said second seal ring being stationarily supported on said gland in said radial space so that said first and second seal rings are relatively rotatable during shaft rotation; and an adapter ring mountable on the pump and removably mounted on said gland wherein said adapter ring has ring fasteners to stationarily mount said adapter ring to the pump, said adapter ring being disposed about the outer gland surface and having a static seal gasket which is disposed in sealing contact with said outer gland surface and permits axial sliding of said outer gland surface along said static seal gasket, such that said gland, said shaft sleeve and said seal rings are axially movable together with the shaft while said outer gland surface remains in sealing contact with said static seal gasket during said sliding.

2. The cartridge seal according to claim 1, wherein said first and second seal rings are provided proximate said inboard sleeve end and said inboard gland end for exposure to a process fluid of the pump, said shaft sleeve being mountable to said shaft for axial movement therewith.

3. The cartridge seal according to claim 2, wherein said shaft sleeve has a setting formation proximate said outboard end which is engagable with said first setting member.

4. The cartridge seal according to claim 3, wherein said setting formation is a groove.

5. The cartridge seal according to claim 1, wherein said adapter ring is non-piloted relative to said ring fasteners to permit adjustment of the radial position of said adapter ring when mounted to said pump, said fasteners fixing the radial position of said adapter ring when tightened and fixing the radial position of said gland in contact therewith.

6. The cartridge seal according to claim 5, wherein said setting members are removable after fixing of the radial position of said adapter ring.

7. The cartridge seal according to claim 1, wherein said gland includes connectors which are connectable to the bearing assembly so that the gland moves axially therewith, said connectors being non-piloted with said gland prior to tightening to accommodate variations in the radial position of the gland by variations in the shaft.

8. A cartridge seal for a pump having a shaft that rotates about a shaft axis and is supported by a bearing assembly that is axially movable with said shaft for adjusting an impeller position, said cartridge seal comprising:

a shaft sleeve which extends axially to define inboard and outboard sleeve ends that respectively define opposite first and second end faces which face axially, said shaft sleeve having an inner sleeve surface facing radially inwardly for close fitting on an outer shaft surface of the shaft;

a cylindrical gland which fits over said shaft sleeve in surrounding relation therewith and defines a radial space between said gland and said shaft sleeve, said gland having an inboard gland end and outboard gland end defining opposite ends of said radial space wherein said outboard gland end has a setting member engagable between said gland and said shaft sleeve to radially and axially locate said gland relative to said shaft sleeve so that said shaft sleeve and said gland are joinable together prior to mounting on said shaft, said gland having outer and inner gland surfaces which face in radially opposite directions wherein said inner gland surface faces toward said shaft sleeve to define said radial space;

at least an opposed pair of first and second seal rings defining opposing seal faces, said first seal ring being supported on said shaft sleeve within said radial space so as to rotate with said shaft sleeve and the shaft, and said second seal ring being stationarily supported on said gland in said radial space so that said first and second seal rings are relatively rotatable during shaft rotation; and an adapter ring mountable on the pump and removably mounted on said gland wherein said adapter ring has ring fasteners to stationarily mount said adapter ring to the pump, said adapter ring being disposed about the outer gland surface and having a static seal gasket which is disposed in sealing contact with said outer gland surface and permits axial sliding of said outer gland surface along said static seal gasket, such that said gland, said shaft sleeve and said seal rings are axially movable together with the shaft while said outer gland surface remains in sealing contact with said static seal gasket during said sliding, said shaft sleeve including shaft sleeve gaskets on said inboard and outboard sleeve ends to prevent fluid leakage between said shaft sleeve and the shaft.

9. The cartridge seal according to claim 8, wherein said shaft sleeve has a setting formation proximate said outboard end which is engagable with said setting member.

10. The cartridge seal according to claim 9, wherein said setting formation is a groove.

11. The cartridge seal according to claim 8, wherein said shaft sleeve gaskets on said inboard and outboard sleeve ends act from respective end faces of said inboard and outboard sleeve ends to seal against opposing surfaces of said shaft seal sleeve and the shaft.

12. The cartridge seal according to claim 11, wherein said adapter ring is non-piloted relative to said ring fasteners to permit adjustment of the radial position of said adapter ring when mounted to said pump, said fasteners fixing the radial position of said adapter ring when tightened and fixing the radial position of said gland in contact therewith.

13. In a high volume pump assembly having a pump casing, an impeller within said pump casing, a shaft rotating said impeller, and a bearing assembly which rotatably supports said shaft and is axially movable to move said shaft and said impeller during impeller adjustments, the pump assembly including a cartridge seal mounted to said shaft for preventing leakage of process fluid in the pump casing, said cartridge seal comprising:

a shaft sleeve which extends axially to define inboard and outboard sleeve ends that respectively define opposite first and second end faces which face axially, said shaft sleeve having an inner sleeve surface facing radially inwardly for close fitting on an outer shaft surface of the shaft, said shaft sleeve being captured axially by said impeller and said bearing assembly so as to move axially therewith;

a cylindrical gland which fits over said shaft sleeve in surrounding relation therewith and defines a radial space between said gland and said shaft sleeve, said gland having an inboard gland end and outboard gland end defining opposite ends of said radial space wherein said outboard gland end has a first setting member engagable between said gland and said shaft sleeve to radially and axially locate said gland relative to said shaft sleeve so that said shaft sleeve and said gland are joinable together prior to mounting on said shaft, said gland having outer and inner gland surfaces which face in radially opposite directions wherein said inner gland surface faces toward said shaft sleeve to define said radial space;

at least an opposed pair of first and second seal rings defining opposing seal faces, said first seal ring being supported on said shaft sleeve within said radial space so as to rotate with said shaft sleeve and the shaft, and said second seal ring being stationarily supported on said gland in said radial space so that said first and second seal rings are relatively rotatable during shaft rotation; and an adapter ring mounted on said pump casing and removably mounted on said gland wherein said adapter ring has ring fasteners to stationarily mount said adapter ring on said pump casing, said adapter ring being disposed about the outer gland surface and having a static seal gasket which is disposed in sealing contact with said outer gland surface and permits axial sliding of said outer gland surface along said static seal gasket, such that said gland, said shaft sleeve and said seal rings are axially movable together with the shaft while said outer gland surface remains in sealing contact with said static seal gasket during said sliding; and second setting members being removably mounted to said inboard ends of said gland and said shaft sleeve, said setting members maintaining fixed radial separation between said inner gland surface relative to said shaft sleeve prior to installation, and defining a fixed radial distance between said inner gland surface and said shaft sleeve which is fixed by said ring fasteners which engage said pump casing.

14. The pump assembly according to claim 13, wherein said adapter ring is non-piloted relative to said ring fasteners to permit adjustment of the radial position of said adapter ring during mounting to said pump casing, said fasteners fixing the radial position of said adapter ring when tightened and fixing the radial position of said gland in contact therewith.

15. The pump assembly according to claim 14, wherein said second setting members are removable after fixing of the radial position of said adapter ring to define said fixed radial distance.

16. The cartridge seal according to claim 13, wherein said gland includes connectors which are connectable to the bearing assembly so that the gland moves axially therewith, said connectors being non-piloted with said gland prior to tightening to accommodate variations in the radial position of the gland due to variations in the shaft.

17. In a high volume pump assembly having a pump casing, an impeller within said pump casing, a shaft rotating said impeller, and a bearing assembly which rotatably supports said shaft and is axially movable to move said shaft and said impeller during impeller adjustments, the pump assembly including a cartridge seal mounted to said shaft for preventing leakage of process fluid in the pump casing, said cartridge seal comprising:

a shaft sleeve which extends axially to define inboard and outboard sleeve ends that respectively define opposite first and second end faces which face axially, said shaft sleeve having an inner sleeve surface facing radially inwardly for close fitting on an outer shaft surface of the shaft, said shaft sleeve being captured axially by said impeller and said bearing assembly so as to move axially therewith;

a cylindrical gland which fits over said shaft sleeve in surrounding relation therewith and defines a radial space between said gland and said shaft sleeve, said gland having an inboard gland end and outboard gland end defining opposite ends of said radial space wherein said outboard gland end has a setting member engagable between said gland and said shaft sleeve to radially and axially locate said gland relative to said shaft sleeve so that said shaft sleeve and said gland are joinable together prior to mounting on said shaft, said gland having outer and inner gland surfaces which face in radially opposite directions wherein said inner gland surface faces toward said shaft sleeve to define said radial space;

at least an opposed pair of first and second seal rings defining opposing seal faces, said first seal ring being supported on said shaft sleeve within said radial space so as to rotate with said shaft sleeve and the shaft, and said second seal ring being stationarily supported on said gland in said radial space so that said first and second seal rings are relatively rotatable during shaft rotation; and an adapter ring mounted on said pump casing and removably mounted on said gland wherein said adapter ring has ring fasteners to stationarily mount said adapter ring on said pump casing, said adapter ring being disposed about the outer gland surface and having a static seal gasket which is disposed in sealing contact with said outer gland surface and permits axial sliding of said outer gland surface along said static seal gasket, such that said gland, said shaft sleeve and said seal rings are axially movable together with the shaft while said outer gland surface remains in sealing contact with said static seal gasket during said sliding, said shaft sleeve including shaft sleeve gaskets on said inboard and outboard sleeve ends to prevent fluid leakage between said shaft sleeve and the shaft when captured between said impeller and said bearing assembly.

18. The cartridge seal according to claim 17, wherein said shaft sleeve gaskets on said inboard and outboard sleeve ends act from respective end faces of said inboard and outboard sleeve ends to seal against opposing surfaces of said shaft seal sleeve and said shaft.

19. The cartridge seal according to claim 18, wherein said adapter ring is non-piloted relative to said ring fasteners to permit adjustment of the radial position of said adapter ring when mounted to said pump, said fasteners fixing the radial position of said adapter ring when tightened and fixing the radial position of said gland in contact therewith.

20. The cartridge seal according to claim 17, wherein said shaft sleeve gaskets on said inboard and outboard sleeve ends are compressed against opposing surfaces of said shaft seal sleeve and said shaft.

* * * * *